US007624764B2

(12) United States Patent
Bruske et al.

(10) Patent No.: US 7,624,764 B2
(45) Date of Patent: Dec. 1, 2009

(54) HEALD SUPPORT BAR OF BENT SHEET METAL

(75) Inventors: Johannes Bruske, Albstadt (DE); Robert Emele, Ringingen (DE)

(73) Assignee: Groz-Beckert KG, Albstadt (DE)

( * ) Notice: Subject to any disclaimer, the term of this patent is extended or adjusted under 35 U.S.C. 154(b) by 100 days.

(21) Appl. No.: 12/078,023

(22) Filed: Mar. 26, 2008

(65) Prior Publication Data

US 2008/0236698 A1 Oct. 2, 2008

(30) Foreign Application Priority Data

Mar. 26, 2007 (EP) ..... 07006140

(51) Int. Cl.
*D03C 9/06* (2006.01)
*D03C 9/00* (2006.01)
*D03C 13/00* (2006.01)

(52) U.S. Cl. ..... 139/92; 139/55.1; 139/82; 139/87; 139/88; 139/89; 139/90; 139/91

(58) Field of Classification Search ..... 139/55.1, 139/82, 87–92
See application file for complete search history.

(56) References Cited

U.S. PATENT DOCUMENTS

| | | | | | |
|---|---|---|---|---|---|
| 1,725,004 | A * | 8/1929 | Kaufmann | 139/92 |
| 2,040,790 | A * | 5/1936 | Kaufmann | 403/78 |
| 2,364,982 | A * | 12/1944 | Kaufmann | 139/92 |
| 2,708,455 | A * | 5/1955 | Kaufmann | 139/92 |
| 3,258,035 | A * | 6/1966 | Fend | 139/436 |
| 4,901,767 | A * | 2/1990 | Koch | 139/92 |
| 5,183,082 | A * | 2/1993 | Baumann | 139/92 |
| 5,230,370 | A | 7/1993 | Gysin | |
| 7,137,415 | B2 * | 11/2006 | Olbing et al. | 139/82 |
| 7,147,010 | B2 * | 12/2006 | Froment et al. | 139/91 |
| 2004/0244862 | A1 * | 12/2004 | Gesing | 139/93 |
| 2005/0241718 | A1 * | 11/2005 | Froment | 139/91 |
| 2006/0102243 | A1 * | 5/2006 | Mettler | 139/91 |
| 2006/0249218 | A1 * | 11/2006 | Mettler | 139/79 |
| 2008/0135121 | A1 * | 6/2008 | Bruske et al. | 139/92 |
| 2009/0065087 | A1 * | 3/2009 | Drope et al. | 139/92 |

FOREIGN PATENT DOCUMENTS

| | | |
|---|---|---|
| CH | 464 112 | 10/1968 |
| DE | 1 887 297 | 2/1964 |
| EP | 0 504 101 | 9/1992 |
| WO | WO 2004057076 A1 * | 7/2004 |

* cited by examiner

*Primary Examiner*—Bobby H Muromoto, Jr.
(74) *Attorney, Agent, or Firm*—Fitch, Even, Tabin & Flannery; Norman N. Kunitz

(57) ABSTRACT

Heald support bar for heald shafts consists of a bent sheet metal element with unbent legs (8, 9), whereby, in the bending zones, the material thickness is reduced before or during the bending process. As a result of the compression occurring during the bending process, the material thickness in the bending region may again increase slighting during the bending process and, optionally, even return to its original value. However, in any event, an increase of the material thickness beyond the original sheet metal thickness is avoided during the bending process.

10 Claims, 2 Drawing Sheets

HEALD SUPPORT BAR OF BENT SHEET METAL

CROSS REFERENCE TO RELATED APPLICATION

This application claims the priority of European Patent Application No. EP 07 006 140.3, filed on Mar. 26, 2007, the subject matter of which, in its entirety, is incorporated herein by reference.

BACKGROUND OF THE INVENTION

The invention relates to a heald support bar for heald shafts.

Various technologies exist for the manufacture of heald shafts and, in particular, for their heald support bars.

For example, German Utility Model DE 1887297 U discloses heald support bars that consists of planar material having an angled edge.

Heald support bars contribute to the weight of heald shafts. One way of reducing the weight is to manufacture heald support bars of sheet metal. During the up-and-down movement of the heald shafts the end eyes of the healds strike the upper and the lower edges of the heald support bar. In order to reinforce the edge, it has frequently been angled, as is obvious from the referenced utility model, for example.

The resultant bent edge must display great strength.

Furthermore, document CH 464 112 discloses a shaft rod which is configured as an element of bent sheet metal having on its edge a U-shaped bent-over region for the accommodation of heald end eyes. Such a shaft rod makes separate heald support bars unnecessary. However, the integrated design makes the respective independent optimization of form and material properties of the shaft rod and of the heald support bar difficult.

A possibility has been sought to manufacture the most robust possible heald support bars of sheet metal.

SUMMARY OF THE INVENTION

The above technical problem has been solved by the heald support bar in accordance with the invention having an elongated sheet metal body that has an edge region that is bent along a bending line extending along said body's longitudinal direction. Preferably, the edge region is bent or folded by approximately 180 degrees. Two legs that are initially preferably essentially straight extend from the resultant bending region. Preferably, the two legs are aligned approximately parallel to each other. They are positioned flat on top of each other or, together, they include a gap which preferably is narrower than the thickness of the sheet metal.

In accordance with the invention the (sheet metal) body is provided with a zone of reducing material thickness along the bending line in order to form the bending region. This means that, in fact, in the region that is subject to the highest stress during use, namely the upper and lower bending edges of the heald support bar, said region has a reduced material thickness. This is the case even though the heald support bar is preferably fabricated of relatively thin sheet metal having a thickness of, e.g., 1 mm or, e.g., only 0.5 mm. Still, the reduction of the material thickness results in an improvement of the material structure in the bending region, thus providing increased strength under conditions of continuous vibrations.

The zone of reduced material thickness may be formed before or after the process of bending the heald support bar. For example, the reduction of the material thickness in the bending region may be achieved by milling. As a matter of principle, however, machining processes such as, for example, grinding processes, are also possible. However, it is preferred that the material thickness be reduced by material displacement. This may contribute to increased cold-setting of the material in the bending region.

Preferably, the reduction of the material thickness is achieved by the formation of a groove having a rounded cross-section. This means that, before or during the bending process for the formation of the bending region, an edge-free cutout is provided in the sheet metal piece of which the heald support bar is being manufactured. The formation of the zone with reduced material thickness preferably takes place in a combined milling and roll-forming process. The corresponding device comprises several rolls and rollers which, on the one hand, form the zone of reduced material thickness by material displacement and, on the other hand, perform the desired bending operation.

Referring to a preferred embodiment, the zone of reduced material thickness covers the entire bending region or extends even into one or both adjoining legs. If the region of reduced wall thickness, in this case, has been formed by material displacement, the entire bending region may be subject to increased cold setting and thus exhibit a greater load-bearing capacity than without the inventive measure.

Furthermore, the reduction of material thickness in the region of the bending zone permits very small radii of curvature and thus the production of particularly slim heald support bars. Correspondingly, the end eyes of connected healds may be configured very narrow and slim, thus contributing to the reduction of the weight of the entire heald shaft.

Additional details of embodiments of the invention are obvious from the drawings, the description or the claims. The drawings and the description are restricted to illustrating only essential aspects of the invention, and miscellaneous situations. Beyond the description, the person skilled in the art will learn additional details from the drawings that supplement the description.

The drawings show an exemplary embodiment of the invention.

DETAILED DESCRIPTION OF THE INVENTION

Figure 1:
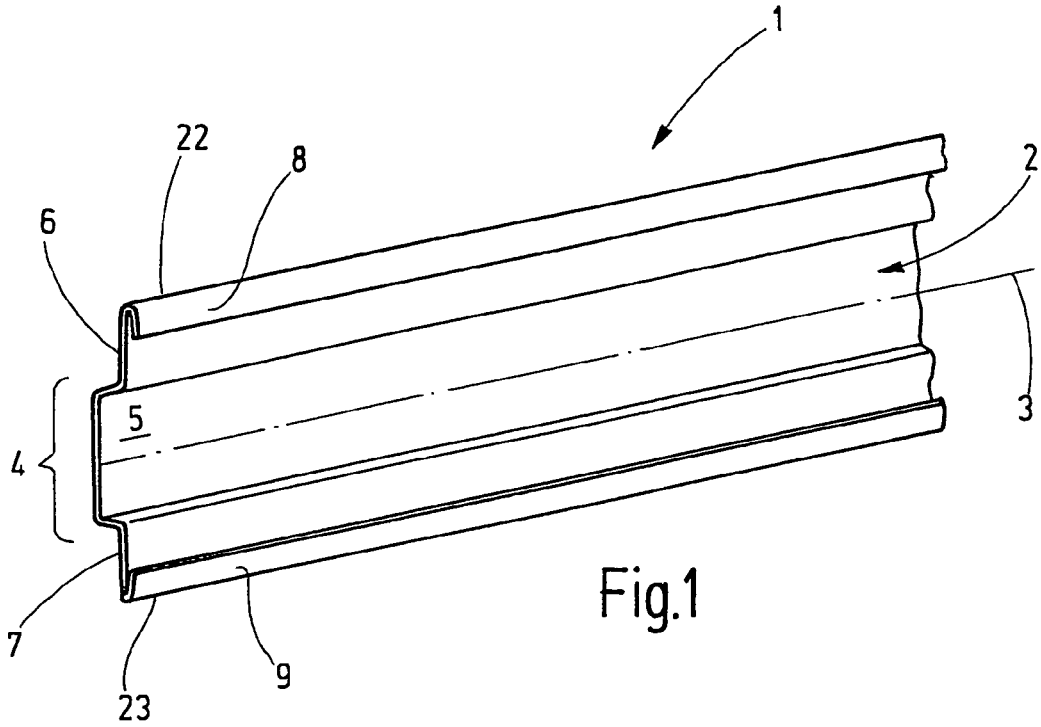
FIG. 1 is a perspective overview of a heald support bar in accordance with the invention.

FIG. 1 shows a heald support bar 1 that may be mounted to a heald shaft in order to accommodate healds. The heald support bar 1 is configured as a bend sheet metal element. It consists, for example, of a strip-shaped elongated body 2 of sheet metal, e.g., sheet steel, e.g., of CrNi 1.410, having a thickness d of, e.g., 1 mm. The body 2 has an elongated strip-shaped configuration, viewed in a direction 3 that may also be viewed as the longitudinal direction. In a central strip-shaped region 4, the heald support bar may be bent one or more times at right angles in order to form, e.g., a mounting section 5. Extending therefrom, e.g., in two different directions facing away from each other, are sections 6, 7 having the form of legs with folded-over strip-shaped edges 8, 9 that are parallel to each other or legs. The sections 6, 7 and the edges

8, 9 may be arranged and/or configured in a mirror-symmetrical manner relative to each other. Hereinafter, the configuration will be described in greater detail considering the section 6 and the edge 8 and with reference to FIG. 2. This description applies analogously to the section 7 and the edge 9.

Figure 3:
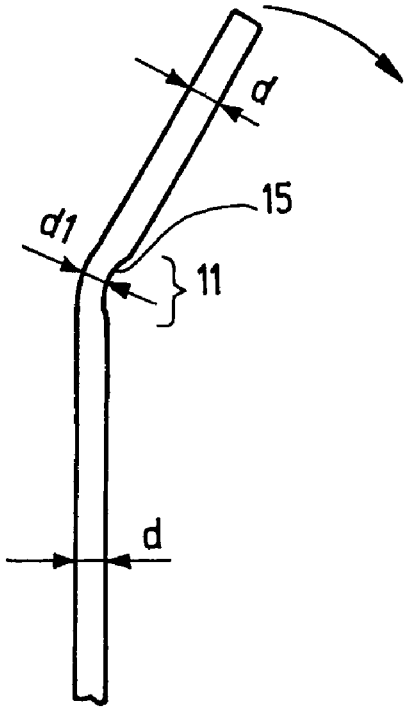
FIG. 3 shows various material thicknesses, referring to the heald support bar before it is finished.

The section 6 and the edge 9 belong to a section of the body 2 having uniform material thickness. In so doing, the term "material thickness" describes the material thickness d as is indicated in FIG. 3. The section 6 and the edge 8 are connected to each other seamlessly in one piece by way of a bending region 10 that represents a 180 degree bend. Overall, the bending region 10, together with the legs formed as a result of the section 6 and the edge 9, has a U-shape. The bending region 10 is provided in a zone 11 that has a reduced material thickness. The zone 11 is obvious from FIG. 3 and is formed, for example, by a groove extending parallel to the direction 3. The material thickness d1 in the zone 11 is reduced by one or a few tenths of a millimeter, compared with the remaining material thickness.

Figure 2:
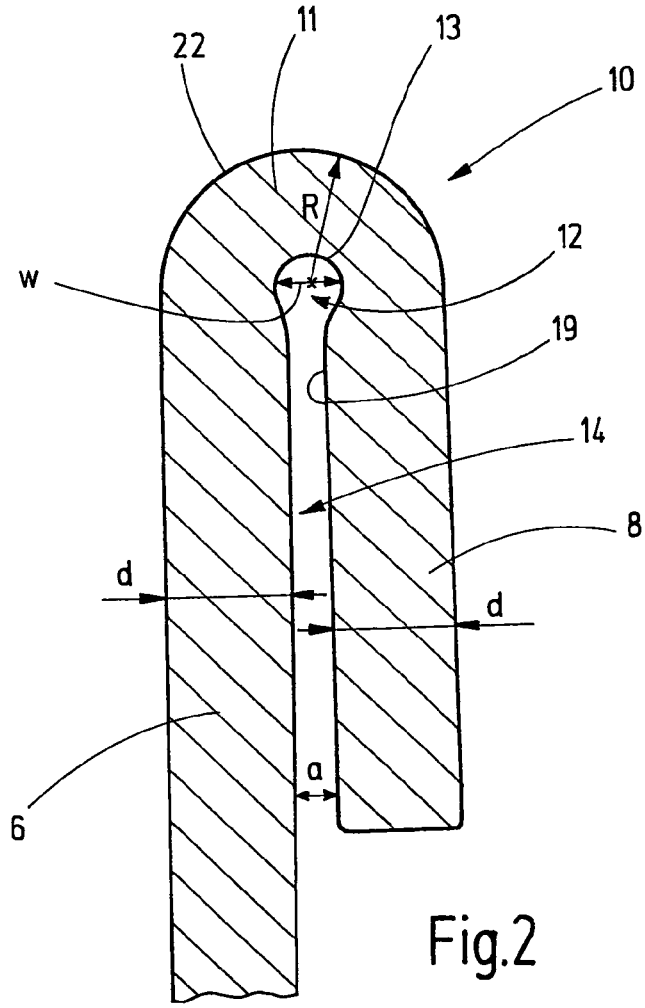
FIG. 2 is a detail, in cross-section, of the heald support bar in accordance with FIG. 1.

Due to the reduction of the material thickness in the zone 11, the part of the heald support bar, which is bent in a semi-circular manner and connects the section 6 and the edge 8 as indicated by FIG. 2, encloses an elongated inner channel 12 which has an essentially smooth and round configuration. The corresponding wall 13 is essentially free of cracks. The width W of the channel 12 that is drawn in FIG. 2 is preferably slightly greater than the distance a between the flat sides of the section 6 and the edge 8, said flat sides facing each other. The distance a may essentially be zero when the section 6 and the edge 8 are positioned flat on each other. Preferably, however, said distance a has a value that is different from zero, said value preferably being smaller than the material thickness d of the section 6 or the edge 8. Consequently, a gap 14, preferably a parallel gap, is formed between the section 6 and the leg 8. The section 6 and the edge 8 have preferably a planar configuration.

The manufacture of the heald support bar 1 may, in principle, be achieved by different methods. These methods have in common that they start with a piece of sheet metal which, in the course of the process, is bent into the desired shape. Before or during the bending process, a zone 11 displaying reduced wall thickness d1 is produced on the sheet metal element, as is obvious from FIG. 3. This recess may be produced, for example, by grinding a groove 15 extending in a direction 3, said groove having a depth of, for example, 0.1 mm to 0.3 mm, or being fixed at another suitable value. For example, the depth of the groove 15 amounts to approximately one tenth to one third of the material thickness d. The shape of the groove 15 corresponds to a shallow depression without sharp edges. It may have a cross-section that is semi-circular, bell-shaped or the like.

Figure 4:
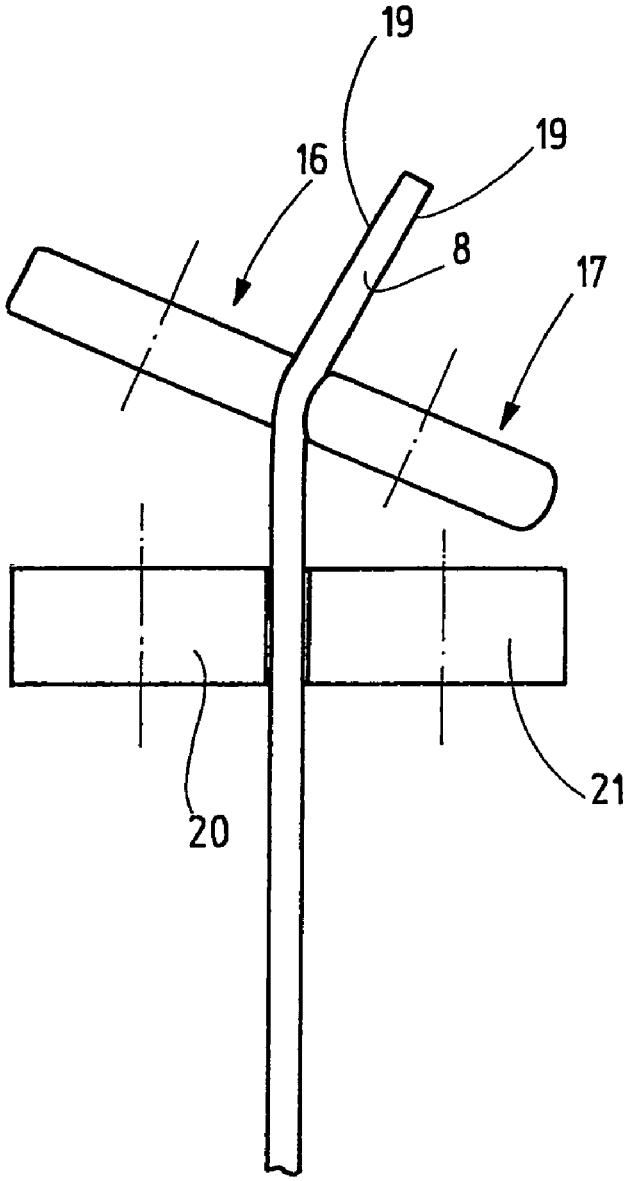
FIG. 4 is a schematic illustration of a detail of the heald support bar during its manufacture.

Preferably, the groove 15 is produced by means of a non-cutting process, for example, a rolling process, whereby the groove 15 is formed as a result of material displacement. FIG. 4 shows this process as it is being carried out with the use of two profiled rollers 16, 17 that contact opposing flat sides 18, 19 of the sheet metal element. In so doing, the groove 15 is formed on the flat side 19, while no recess is formed on the flat side 18. The groove 15 or other recess for the formation of the zone 11 displaying reduced material thickness is thus applied asymmetrically, i.e., only on one side, to the sheet metal element. It is, as shown by FIG. 2, provided on that flat side 19 that ultimately also delimits the gap 14 and the channel 12. In other words, the groove 15 is preferably provided on the inside of the bending region 10. By roll-forming the groove 15 on the inside of the resultant bend during the bending process, the development of cracks due to tension on the outside of the bending region and the formation of compression cracks on the inside of the bending region are avoided.

FIG. 4, furthermore, shows the formation of the heald support bar 1 in a combined machining operation, where, on the one hand, the rollers 16, 18 are used to produce the zone 11 due to material displacement and where, on the other hand, additional rollers 20, 21, as well as other not illustrated, rollers are used in order to bend the edge 8 by 180 degrees, in order to obtain the shape shown by FIG. 2.

The finished heald support bar 1 comprises, for the accommodation of the heald eyes, a narrow heald support surface 22 that extends in longitudinal direction and is curved perpendicularly thereto, whereby the metal of the sheet metal element is slightly elongated at said support surface. In contrast, the metal at the wall 13 is slightly compressed. Because of the reduction of the wall thickness due to material displacement by means of the rollers 16, 17 and the subsequent bending, this zone is largely cold-set, in which case only minimal crack formation occurs. In so doing, a heald support bar 1 is obtained, which, in particular in the region of its heald support surface 22 and, correspondingly, also on its lower heald support surface 23 in FIG. 1, has a cold-set surface with few cracks. This concept permits the manufacture of heald support bars of relatively thin sheet metal, while, on the one hand, a high load-bearing capacity, and, on the other hand, a low weight are achieved.

The inventive heald support bar for heald shafts consists of a bent sheet metal element with unbent legs 8, 9, whereby, in the bending zones, the material thickness is reduced before or during the bending process. As a result of the compression occurring during the bending process, the material thickness in the bending region may again increase slighting during the bending process and, optionally, even return to its original value. However, in any event, an increase of the material thickness beyond the original sheet metal thickness is avoided during the bending process.

LIST OF REFERENCE NUMBERS

1 Heald support bar
2 Body
3 Direction
4 Region
5 Mounting section
6, 7 Sections
8, 9 Edge, leg
d, d1 Material thickness
10 Bending region
11 Zone
12 Channel
13 Wall
w Width
a Distance
14 Gap
15 Groove
16, 17 Rolls
18, 19 Flat sides
20, 21 rolls
22, 23 Heald support surface

The invention claimed is:

1. Heald support bar (1) for heald shafts, comprising a sheet metal body (2) that is elongated in a direction (2), said body being bent along a bending line extending in the direction (3), thus defining a bending region (10), whereby the body (2) is provided with a zone (11) of reduced material thickness, said zone extending along the bending line in order to form the bending region (10).

2. Heald support bar in accordance with claim 1, characterized in that the zone (11) of reduced material thickness is formed before the bending process is carried out.

3. Heald support bar in accordance with claim 1, characterized in that the zone (11) of reduced material thickness is formed during the bending process.

4. Heald support bar in accordance with claim 1, characterized in that the zone (11) of reduced material thickness is formed during a rolling process resulting in material displacement.

5. Heald support bar in accordance with claim 1, characterized in that the zone (11) of reduced material thickness is formed by a recess (15) provided along the bending line that is to be produced.

6. Heald support bar in accordance with claim 1, characterized in that the zone (11) of reduced material thickness is located on a side of the bending region (10) that is on the inside after the formation of the bending region (10).

7. Heald support bar in accordance with claim 1, characterized in that the zone (11) of reduced material thickness has a rounded cross-section.

8. Heald support bar in accordance with claim 1, characterized in that the zone (11) of reduced material thickness has a width covering the entire bending region (10).

9. Heald support bar in accordance with claim 1, characterized in that the body has two legs (6, 8) which are connected to each other by way of the bending region (10).

10. Heald support bar in accordance with claim 9, characterized in that, together, the legs (6, 8) define a gap (14) having a width (a) that is smaller than the width (w) of a channel (12) delimited by the bending region (10).

* * * * *